US010385629B2

(12) United States Patent
Spence et al.

(10) Patent No.: US 10,385,629 B2
(45) Date of Patent: Aug. 20, 2019

(54) DUAL COILED TUBING HEAD

(71) Applicants: Dean Spence, Sylvan Lake (CA); Leigh McDiarmid, Bentley (CA)

(72) Inventors: Dean Spence, Sylvan Lake (CA); Leigh McDiarmid, Bentley (CA)

( * ) Notice: Subject to any disclaimer, the term of this patent is extended or adjusted under 35 U.S.C. 154(b) by 307 days.

(21) Appl. No.: 15/447,421

(22) Filed: Mar. 2, 2017

(65) Prior Publication Data

US 2017/0254178 A1 Sep. 7, 2017

(30) Foreign Application Priority Data

Mar. 2, 2016 (CA) ..... 2922285

(51) Int. Cl.

| | |
|---|---|
| ***E21B 17/18*** | (2006.01) |
| ***E21B 21/12*** | (2006.01) |
| ***E21B 17/20*** | (2006.01) |
| *E21B 17/042* | (2006.01) |
| *E21B 34/06* | (2006.01) |
| *E21B 34/10* | (2006.01) |
| *E21B 34/14* | (2006.01) |

(52) U.S. Cl.

CPC ..... *E21B 17/18* (2013.01); *E21B 17/203* (2013.01); *E21B 21/12* (2013.01); *E21B 17/042* (2013.01); *E21B 17/20* (2013.01); *E21B 34/063* (2013.01); *E21B 34/10* (2013.01); *E21B 34/14* (2013.01)

(58) Field of Classification Search

CPC ..... E21B 17/18; E21B 17/203; E21B 21/12
See application file for complete search history.

(56) References Cited

U.S. PATENT DOCUMENTS

| | | | | |
|---|---|---|---|---|
| 3,670,566 | A | 6/1972 | Basham et al. | |
| 4,997,041 | A | 3/1991 | Petree | |
| 5,303,776 | A | 4/1994 | Ryan | |
| 5,392,851 | A | 2/1995 | Arend | |
| 6,196,325 | B1 | 3/2001 | Connell et al. | |
| 8,281,851 | B2 | 10/2012 | Spence | |
| 2009/0095466 | A1 | 4/2009 | Obrejanu | |
| 2012/0031615 | A1* | 2/2012 | Connell | E21B 43/114 166/298 |

* cited by examiner

*Primary Examiner* — Kristyn A Hall
(74) *Attorney, Agent, or Firm* — Davis & Bujold PLLC; Michael J. Bujold

(57) ABSTRACT

A dual coiled tubing head has an outer coiled tubing connector, an inner coiled tubing connector, a central housing and a bottom housing. The inner coiled tubing connector fits within the outer coiled tubing connector such that a passage is created between the inner coiled tubing connector and the outer coiled tubing connector to allow for the passage of fluid through the outer coiled tubing connector. A central housing is connected to the outer and inner coiled tubing connectors. The central housing has a central passage, a peripheral downhole passage and an outlet. The peripheral downhole passages are in fluid communication with the outer coiled tubing connector. The bottom housing connects to the central housing. The bottom housing has a central passage. The central passage is in fluid communication with the peripheral downhole passages for permitting downhole flow of fluid from the exterior coiled tubing connector.

18 Claims, 11 Drawing Sheets

DUAL COILED TUBING HEAD

FIELD OF THE DISCLOSURE

The present application relates generally to an apparatus for attaching dual coiled tubing to a downhole tool or bottom hole assembly

BACKGROUND

This section provides background information to facilitate a better understanding of the various aspects of the invention. It should be understood that the statements in this section of this document are to be read in this light, and not as admissions of prior art.

When using downhole tools, it is often necessary to pump different types of fluids downhole. In the case of downhole milling or drilling, nitrogen and water are pumped through a single coiled tubing and through a tool string that includes a positive displacement motor. The nitrogen is used to provide underbalanced pressure to the well which pushes milling or drilling debris to the surface when a well lacks sufficient pressure to overcome the hydrostatic pressure in the wellbore. Water is pumped downhole to run the motor. Nitrogen can cause accelerated deterioration of the rubber in the stator of the positive displacement motor. By pumping water with nitrogen in it downhole, there is a risk that the well can become choked off with fluid.

BRIEF SUMMARY

There is provided a dual coiled tubing head that has an outer coiled tubing connector, an inner coiled tubing connector, a central housing and a bottom housing. The outer coiled tubing connector has a hollow body with an outer coil connection end and a central housing connection end. The inner coiled tubing connector has a hollow body with an inner coiled tubing connection end and a central housing connection end. The inner coiled tubing connector is sized to fit within the outer coiled tubing connector such that a passage is created between an outer surface of the inner coiled tubing connector and an inner surface of the outer coiled tubing connector to allow for the passage of fluid through the outer coiled tubing connector.

The central housing has a top end and a bottom end. The top end has an exterior connection for connection to the central housing connection end of the outer coiled tubing connector and an interior connection for connection to the central housing connection end of the inner coiled tubing connector. The bottom end has a bottom housing connection end. The central housing has a central passage, at least one peripheral downhole passage and at least one outlet connecting the central passage to an exterior of the central housing. The central passage is in fluid communication with the inner coiled tubing connector and has at least one one-way valve to permit downward flow of fluid. The at least one peripheral downhole passage is in fluid communication with the outer coiled tubing connector. The central passage is sealed at the bottom end to prevent the flow of fluid from the inner coiled tubing connector further downhole.

The bottom housing has a central passage, a bottom end and a top end. The top end has a central housing connection for connection to the bottom housing connection end of the central housing. The central passage is in fluid communication with the at least one peripheral downhole passage and has at least one one-way valve for permitting downhole flow of fluid from the exterior coiled tubing connector.

In one embodiment, the dual coiled tubing head has a first piston housed within the central passage of the central housing and a second piston housed within the central passage of the bottom housing. The first piston has a ball seat at a top end, a sealed bottom end, a hollow interior and at least one orifice. The hollow interior is in fluid communication with the inner coiled tubing connector and houses the at least one one-way valve that permits downward flow. The at least one orifice is positioned below the at least one one-way valve and is in fluid communication with the central passage of the central housing. The second piston has a hollow interior, an inlet and an outlet. The inlet is in fluid communication with the at least one peripheral downhole passage and the hollow interior of the second piston. The hollow interior houses the at least one one-way valve for permitting downward flow from the outer coiled tubing connector through the outlet.

In a further embodiment, a plurality of shear pins are provided in the bottom housing and contact a groove on the second piston for maintaining the second piston in position within the central passage. The shear pins are sheared when a ball is dropped onto the ball seat of the first piston which causes the first piston to move downwards within the central housing and contacts the second piston in the bottom housing which in turn causes the shear pins to be sheared and the second piston to drop within the bottom housing.

In a further embodiment, two one-way valves are provided in the central housing. Two one-way valves may also be provided in the bottom housing.

In a further embodiment, there are six pairs of peripheral downhole passaged spaced equidistant from the central passage.

In a further embodiment, there are six outlets spaced evenly on the exterior of the central housing.

In a further embodiment, the outer coiled tubing connector and the inner coiled tubing connector are attached to the coiled tubing using set screws or slips.

In a further embodiment, outer coiled tubing connector, inner coiled tubing connector, central housing and bottom housing are connected by threads. The central housing connection of the outer coiled tubing connector has interior threads. The central housing connection of the inner coiled tubing connector has exterior threads. The exterior connection of the central housing has exterior threads for connection to the interior threads of the outer coiled tubing connector. The interior connection of the central housing has interior threads for connection to the exterior threads of the inner coiled tubing connector. The bottom housing connection end of the central housing has exterior threads. The central housing connection on the bottom housing has interior threads for connection to the exterior threads of the bottom housing connection end of the central housing.

There is also provided a dual coiled tubing head that has an outer coiled tubing connector, an inner coiled tubing connector, a central housing, a first piston and a bottom housing. The outer coiled tubing connector has a hollow body with an outer coil connection end and a central housing connection end. The inner coiled tubing connector has a hollow body with an inner coil connection end and a central housing connection end. The inner coiled tubing connector is sized to fit within the outer coiled tubing connector such that a passage is created between an outer surface of the inner coiled tubing connector and an inner surface of the outer coiled tubing connector to allow for the passage of fluid through the outer coiled tubing connector.

The central housing has a top end and a bottom end. The top end has an exterior connection for connection to the central housing connection end of the outer coiled tubing connector and an interior connection for connection to the central housing connection end of the inner coiled tubing connector. The bottom end has a bottom housing connection end. The central housing has a central passage, at least one peripheral downhole passage. A first piston is housed within the central passage of the central housing. The first piston has a ball seat at an inlet end, a sealed bottom end, at least one orifice and a hollow interior. The inlet end is in fluid communication with the inner coiled tubing connector and the hollow interior. The hollow interior houses at least one one-way valve that permits downward flow. The at least one orifice is positioned below the at least one one-way valve and is in fluid communication with the at least one outlet of the central housing.

The bottom housing has a central passage, a bottom end and a top end. The top end has a central housing connection for connection to the bottom housing connection end of the central housing. The central passage is in fluid communication with the at least one peripheral downhole passage and has at least one one-way valve for permitting downhole flow of fluid from the exterior coiled tubing connector.

In one embodiment, a second piston has a hollow interior, an inlet and an outlet. The inlet is in fluid communication with the at least one peripheral downhole passage and the hollow interior of the second piston. The hollow interior houses the at least one one-way valve for permitting downward flow from the outer coiled tubing connector through the outlet.

In a further embodiment, a plurality of shear pins are provided in the bottom housing and contact a groove on the second piston for maintaining the second piston in position within the central passage. The shear pins are sheared when a ball is dropped onto the ball seat of the first piston which causes the first piston to move downwards within the central housing and contacts the second piston in the bottom housing which in turn causes the shear pins to be sheared and the second piston to drop within the bottom housing.

In a further embodiment, two one-way valves are provided in the central housing. Two one-way valves may also be provided in the bottom housing.

In a further embodiment, there are six pairs of peripheral downhole passaged spaced equidistant from the central passage.

In a further embodiment, there are six outlets spaced evenly on the exterior of the central housing.

In a further embodiment, the outer coiled tubing connector and the inner coiled tubing connector are attached to a coiled tubing using set screws or slips.

In a further embodiment, outer coiled tubing connector, inner coiled tubing connector, central housing and bottom housing are connected by threads. The central housing connection of the outer coiled tubing connector has interior threads. The central housing connection of the inner coiled tubing connector has exterior threads. The exterior connection of the central housing has exterior threads for connection to the interior threads of the outer coiled tubing connector. The interior connection of the central housing has interior threads for connection to the exterior threads of the inner coiled tubing connector. The bottom housing connection end of the central housing has exterior threads. The central housing connection on the bottom housing has interior threads for connection to the exterior threads of the bottom housing connection end of the central housing.

BRIEF DESCRIPTION OF THE DRAWINGS

These and other features will become more apparent from the following description in which references are made to the following drawings, in which numerical references denote like parts. The drawings are for the purpose of illustration only and are not intended to in any way limit the scope of the invention to the particular embodiments shown.

DETAILED DESCRIPTION OF THE PREFERRED EMBODIMENTS

Figure 1:
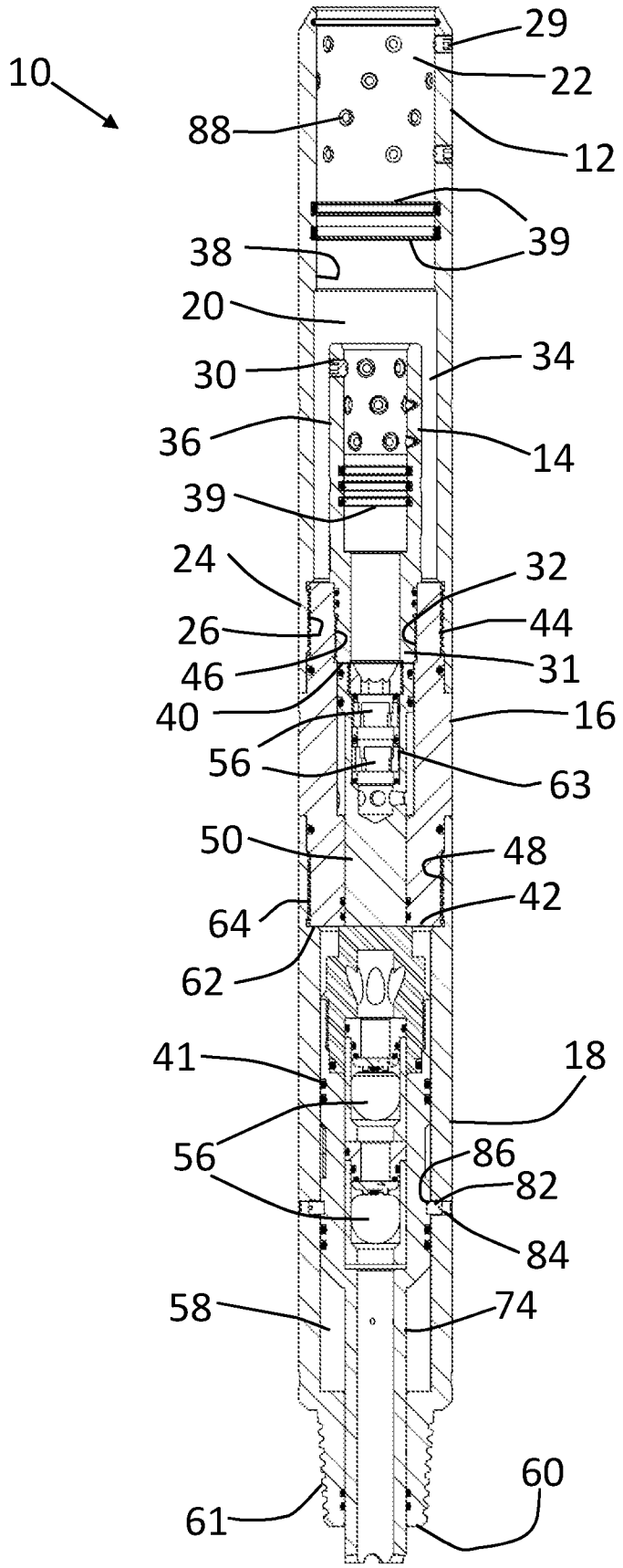
FIG. 1 is a side elevation view, in section, of a dual coiled tubing head.

A dual coiled tubing head, generally identified by reference numeral 10, will now be described with reference to FIG. 1 through FIG. 19.

Figure 6:
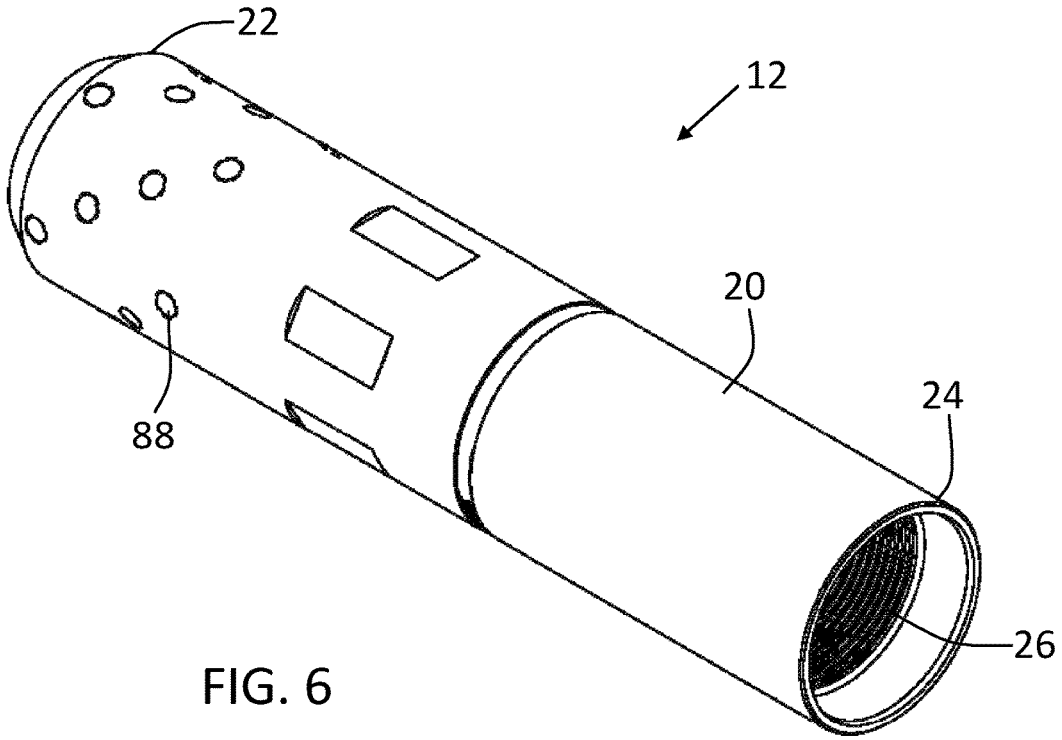
FIG. 6 is a perspective view of the outer coiled tubing connector of the dual coiled tubing head.
Figure 7:
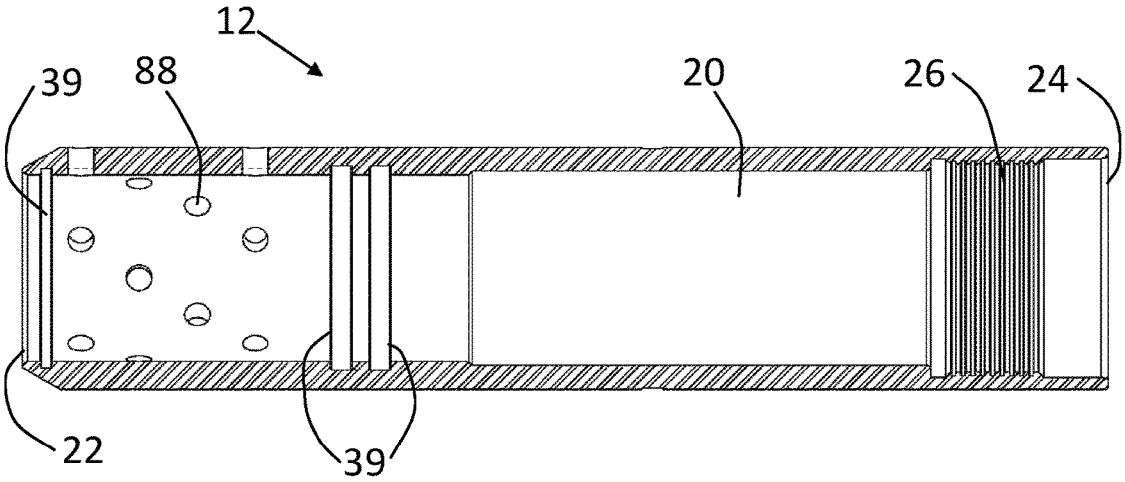
FIG. 7 is a side elevation view, in section, of the outer coiled tubing connector of the dual coiled tubing head shown in FIG. 6.
Figure 8:
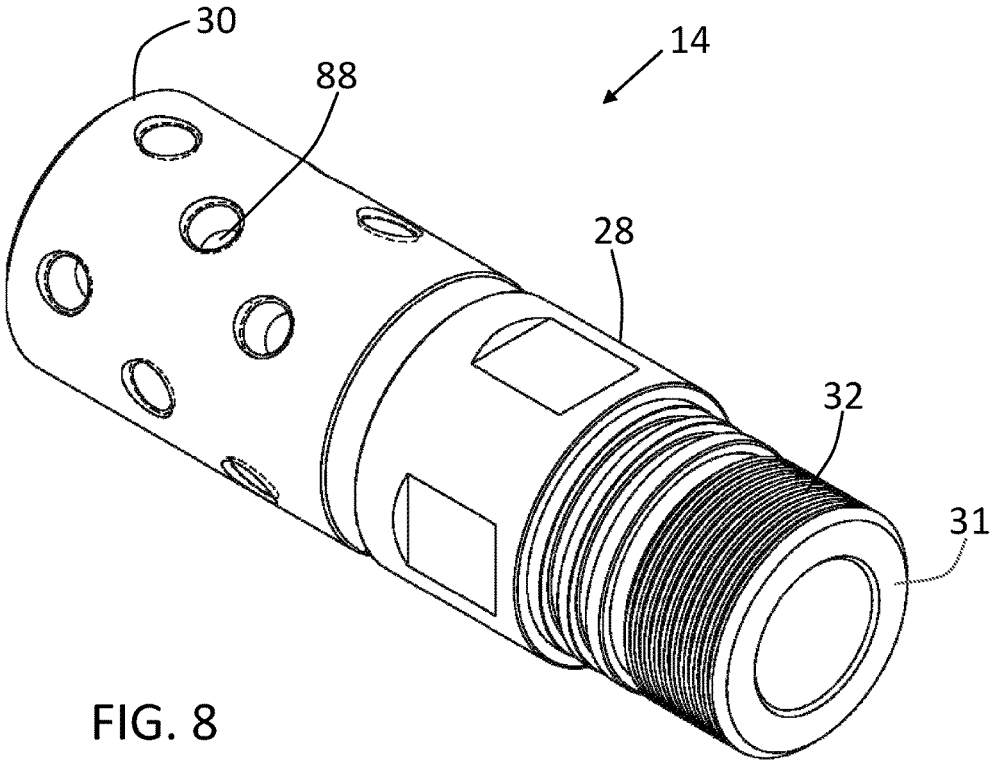
FIG. 8 is a perspective view of the interior coil connection of the dual coiled tubing head.
Figure 9:
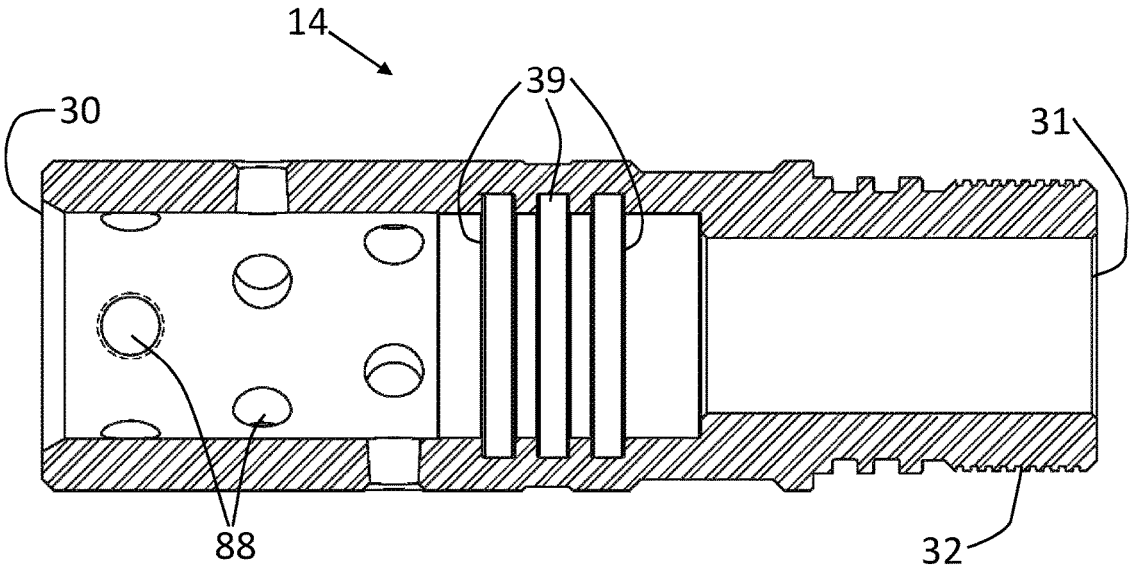
FIG. 9 is a side elevation view, in section, of the interior coil connection of the dual coiled tubing head shown in FIG. 8.

Referring to FIG. 1, a dual coiled tubing head 10 has an outer coiled tubing connector 12, an inner coiled tubing connector 14, a central housing 16 and a bottom housing 18. Referring to FIG. 6 and FIG. 7, outer coiled tubing connector 12 has a hollow body 20 that has an outer coil connection end 22 and a central housing connection end 24 that has interior threads 26. Referring to FIG. 8 and FIG. 9, inner coiled tubing connector 14 has a hollow body 28 that has an inner coil connection end 30 and a central housing connection end 31 that has exterior threads 32. Referring to FIG. 1, inner coiled tubing connector 14 is sized to fit within outer coiled tubing connector 12 such that a passage 34 is created between an outer surface 36 of inner coiled tubing connector 14 and an inner surface 38 of outer coiled tubing connector 12 to allow for the passage of fluid through outer coiled tubing connector 12. Set screws 29 are used to connect the inner coil and outer coil of dual coiled tubing to the inner coiled tubing connector 14 and outer coiled tubing connector 12, respectively. The inner coil and outer coil of dual coiled tubing may be pre dimpled to allow for a greater connection with set screws.

Figure 4:
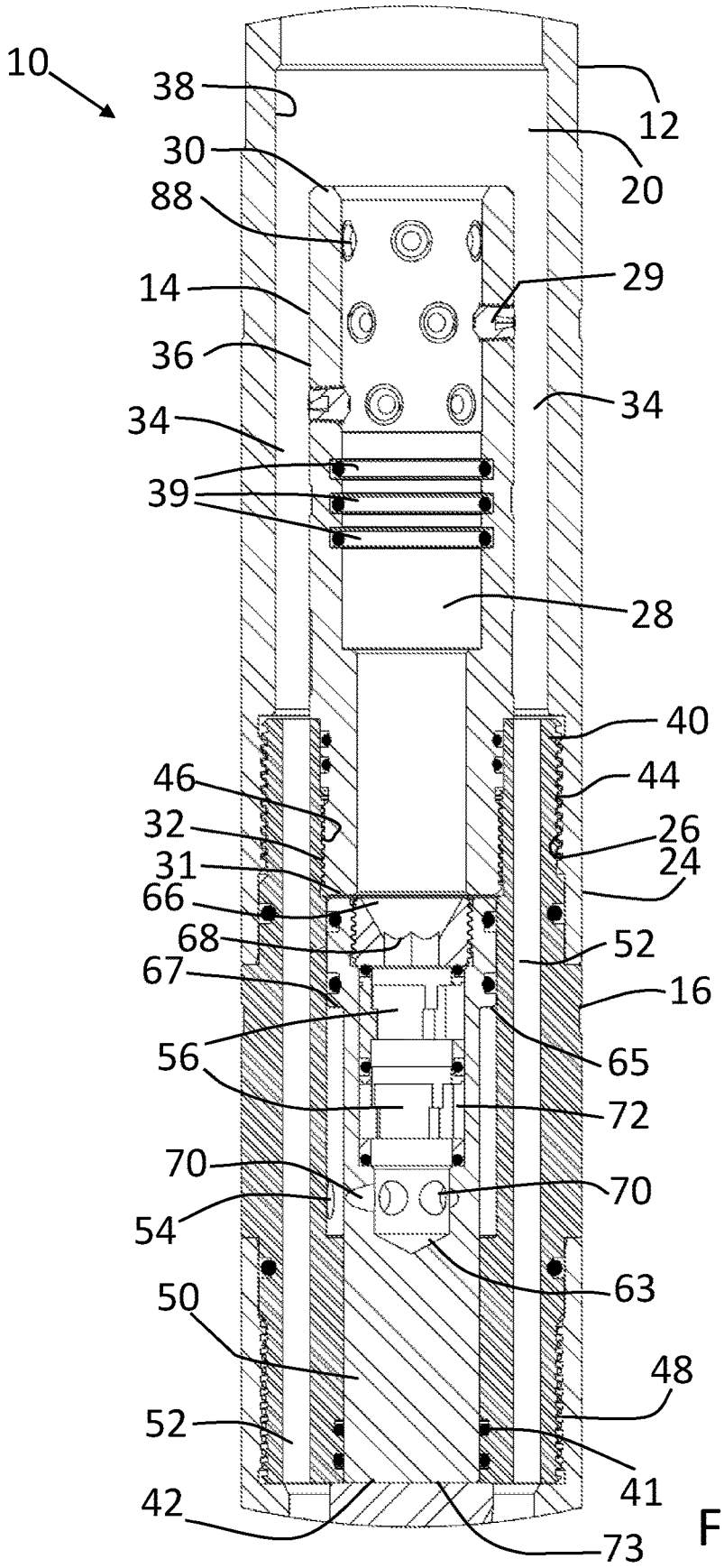
FIG. 4 is a detailed view, in section, of the inner coiled tubing connector and central housing of the dual coiled tubing head shown in FIG. 1.

Referring to FIG. 1, seals 39 are provided within hollow body 20 of outer coiled tubing connector 12. When an outer coil of dual coiled tubing is connected to outer coiled tubing connector 12, it is pushed into hollow body 20 of outer coiled tubing connector 12 until it has passed seals 39. Seals 39 help to prevent fluid from escaping upwards between outer coiled tubing connector 12 and outer coil of tubing. Referring to FIG. 4, seals 39 are provided within hollow body 28 of inner coiled tubing connector 14. When an inner coil of dual coiled tubing is connected to inner coiled tubing connector 14, it is pushed into hollow body 28 of inner coiled tubing connector 14 until it has passed seals 39. Seals 39 help to prevent fluid from escaping upwards between inner coiled tubing connector 14 and inner coil of tubing into hollow body 20 of outer coiled tubing connector 12.

Figure 10:
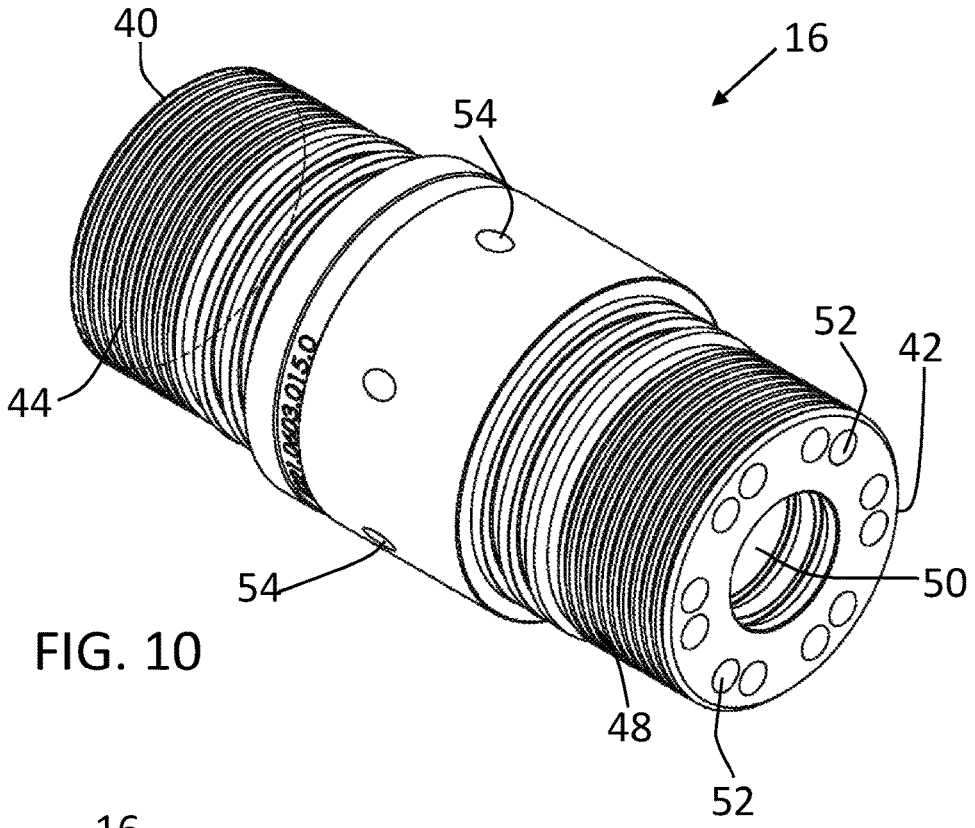
FIG. 10 is a perspective view of the central housing of the dual coiled tubing head.
Figure 11:
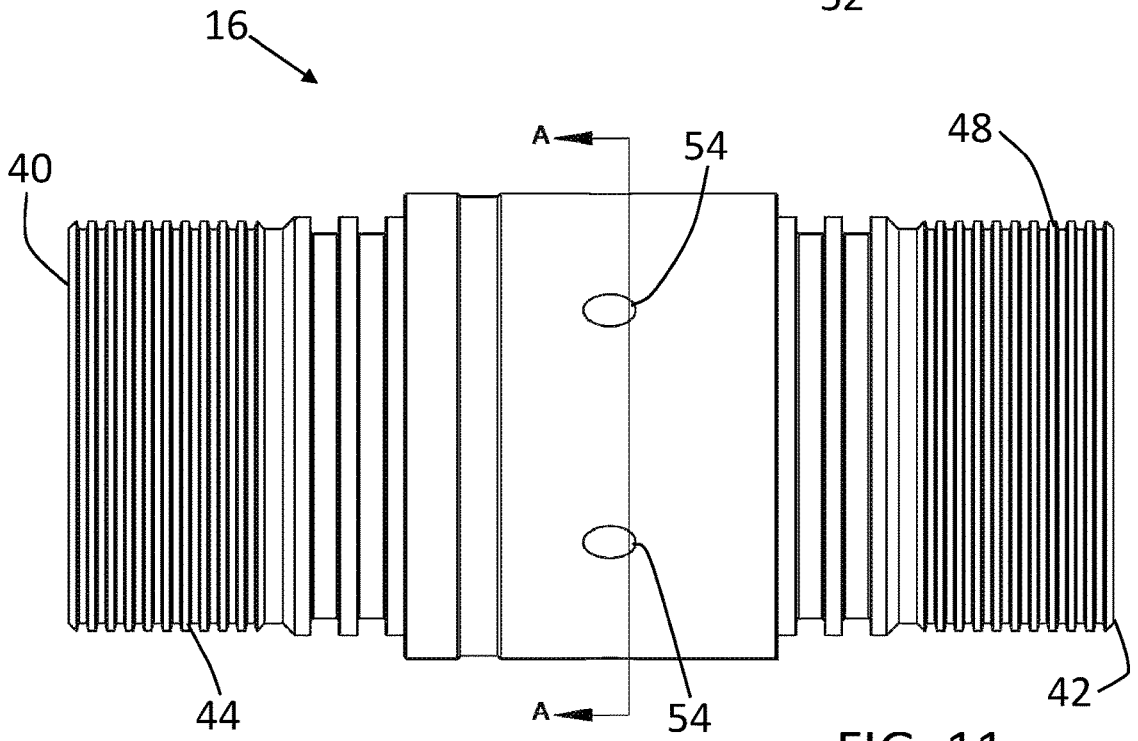
FIG. 11 is a side elevation view of the central housing of the dual coiled tubing head shown in FIG. 10.
Figure 12:
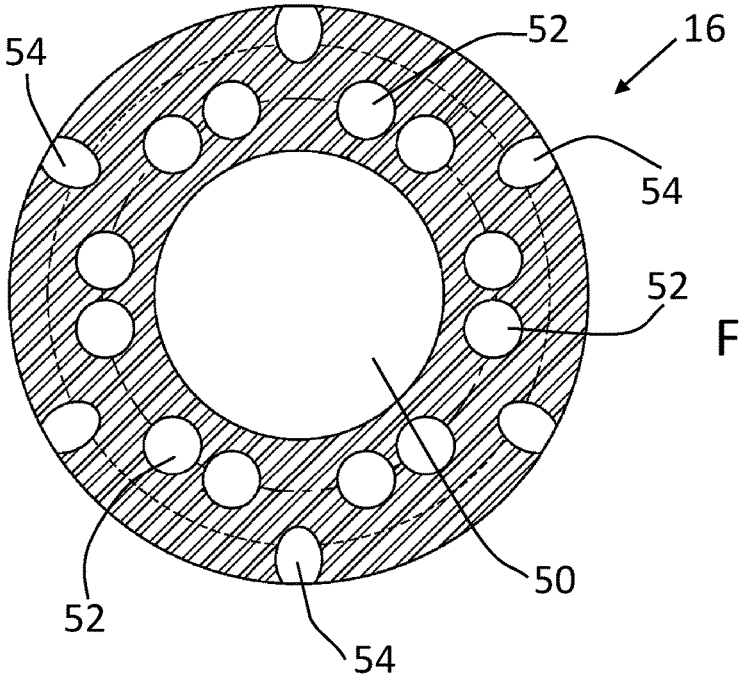
FIG. 12 is a cross sectional view of the line A-A shown in FIG. 11.
Figure 13:
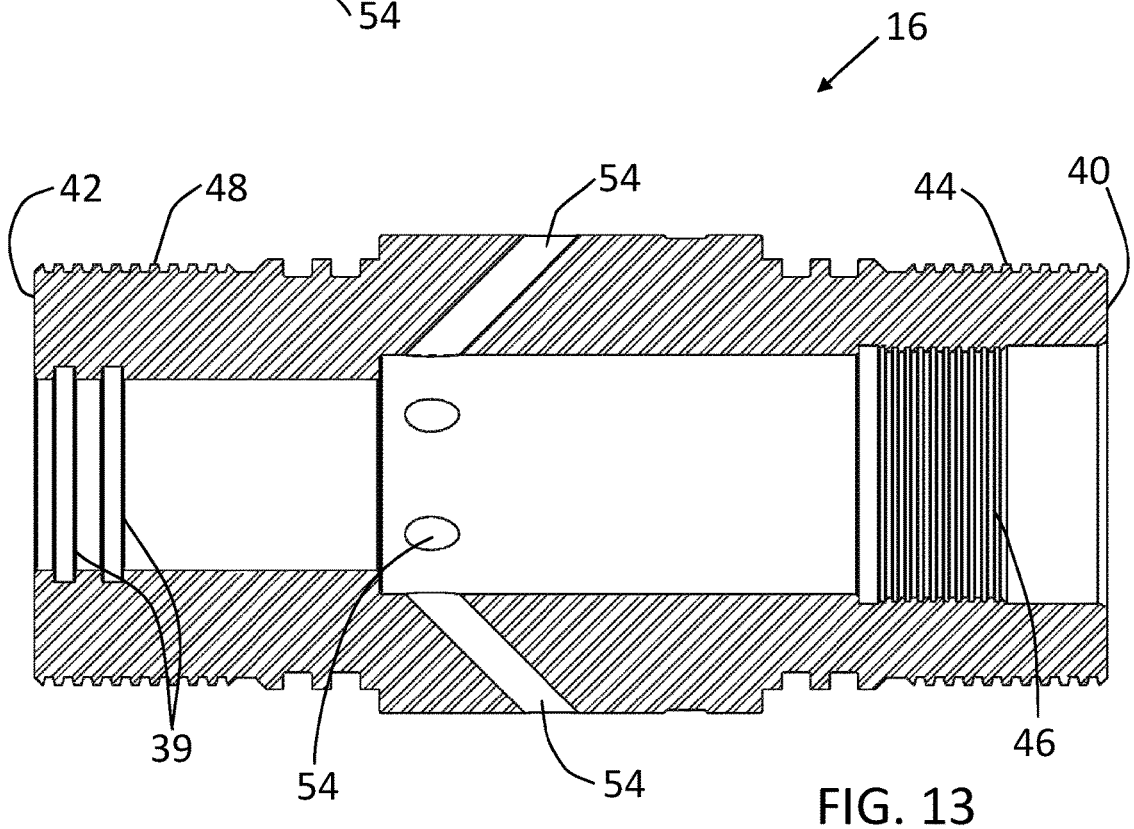
FIG. 13 is a side elevation view, partially in section, of the central housing of the dual coiled tubing head shown in FIG. 10.

Referring to FIG. 10 and FIG. 11, central housing 16 has a top end 40 and a bottom end 42. Referring to FIG. 13, top end 40 has exterior threads 44 for threadingly engaging interior threads 26 of outer coiled tubing connector 12, as shown in FIG. 4. Interior threads 46 threadingly engage exterior threads 32 of inner coiled tubing connector 14, as shown in FIG. 4. Bottom end 42 has a bottom housing connection 48 with exterior threads. Referring to FIG. 12, central housing 16 has a central passage 50, at least one peripheral downhole passage 52 and at least one outlet 54.

In one embodiment, not shown, central passage 50 is in fluid communication with inner coiled tubing connector 14 and houses a one-way valve 56 that permits downward flow of fluid. Central passage 50 is sealed at bottom end 42 to prevent the flow of fluid from inner coiled tubing connector 14 further downhole. The at least one peripheral downhole passage 52 is in fluid communication with outer coiled tubing connector 12. In the embodiment shown, six pairs of peripheral downhole passages 52 are used. A person of skill will understand that the number and size of peripheral downhole passages 52 may be changed to affect the flow rate of the fluid flowing from outer coiled tubing connector 12 through peripheral downhole passages 52.

Figure 14:
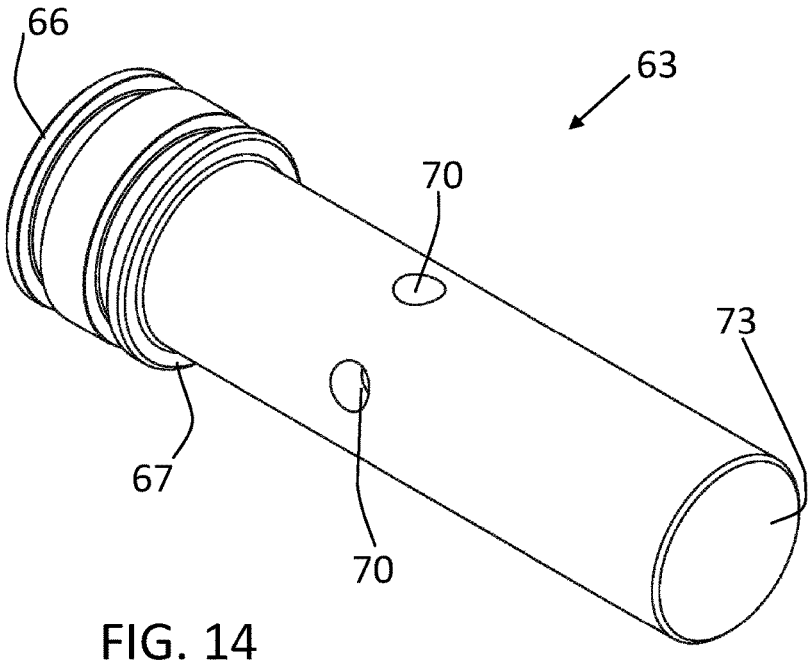
FIG. 14 is a perspective view of the piston housed within the central housing of the dual coiled tubing head.
Figure 15:
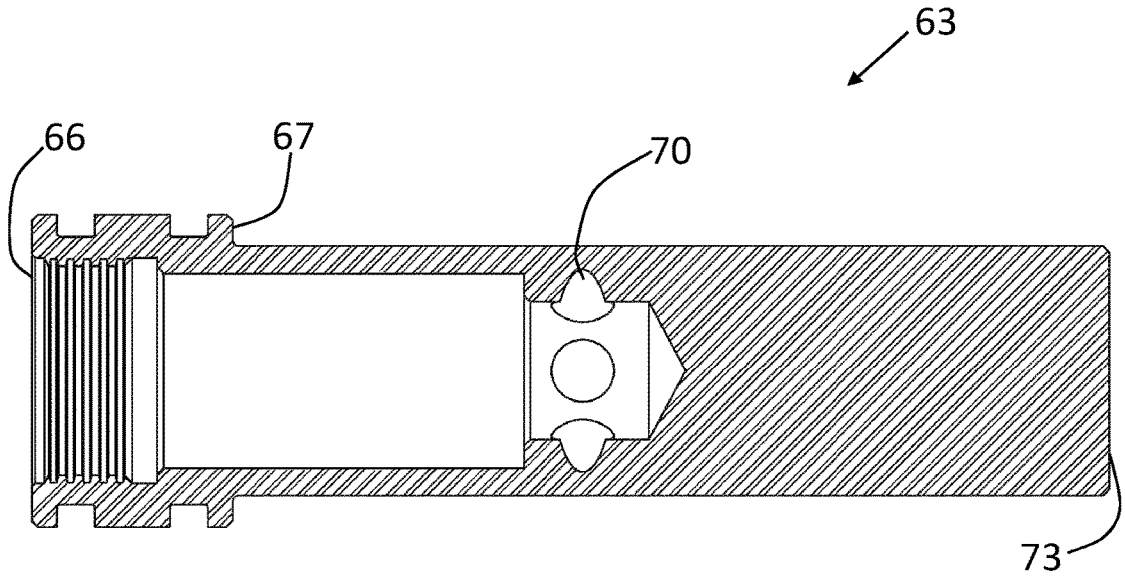
FIG. 15 is a side elevation view, in section, of the piston shown in FIG. 14.

Referring to FIG. 4, in the embodiment shown, a first piston 63, shown in detail in FIG. 14 and FIG. 15, is housed within central passage 50 of central housing 16. Central housing 16 has an interior shoulder 65 on which a shoulder 67 of first piston 63 rests. Several o-rings 41 are used to seal first piston 63 within central passage 50. First piston 63 has a top or inlet end 66 with a ball seat 68, at least one orifice 70, a hollow interior 72 and a sealed bottom end 73. Inlet end 66 of first piston 63 is in fluid communication with inner coiled tubing connector 14 and hollow interior 72. Hollow interior 72 houses one-way valve 56 that permits downward flow of fluid. In the embodiment shown, two one-way valves 56 are provided. By providing more than one one-way valve 56, there is a built in redundancy in the event that one of the one-way valves fails. Orifice 70 are positioned below one-way valves 56 and are in fluid communication with outlets 54 of central housing 16. Fluid is vented out of central housing 16 through outlets 54. When first piston 63 is present, central passage 50 does not need to be sealed since fluid travels into first piston 63 and not central passage 50.

Figure 5:
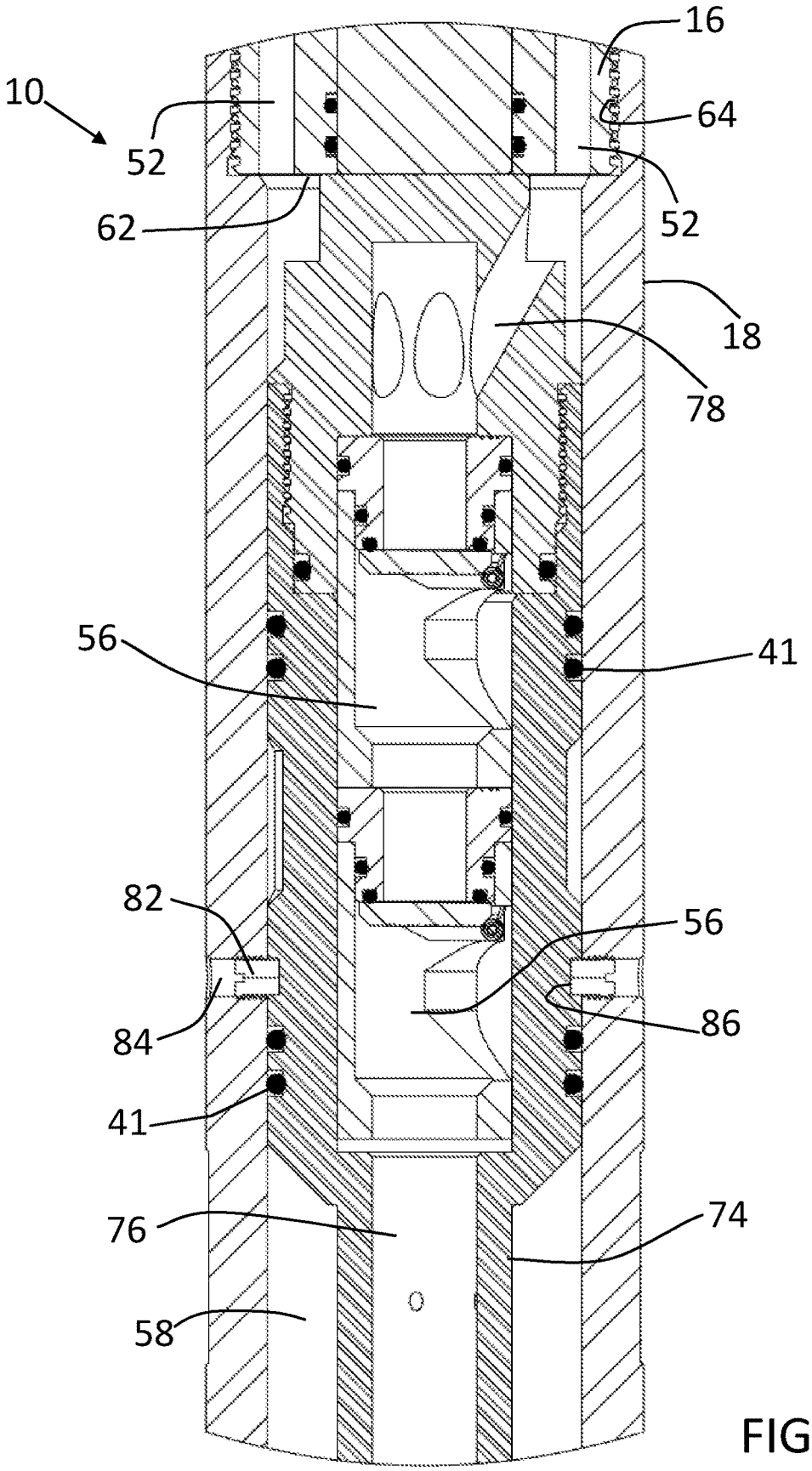
FIG. 5 is a detailed view, in section, of the bottom housing of the dual coiled tubing head shown in FIG. 1.
Figure 16:
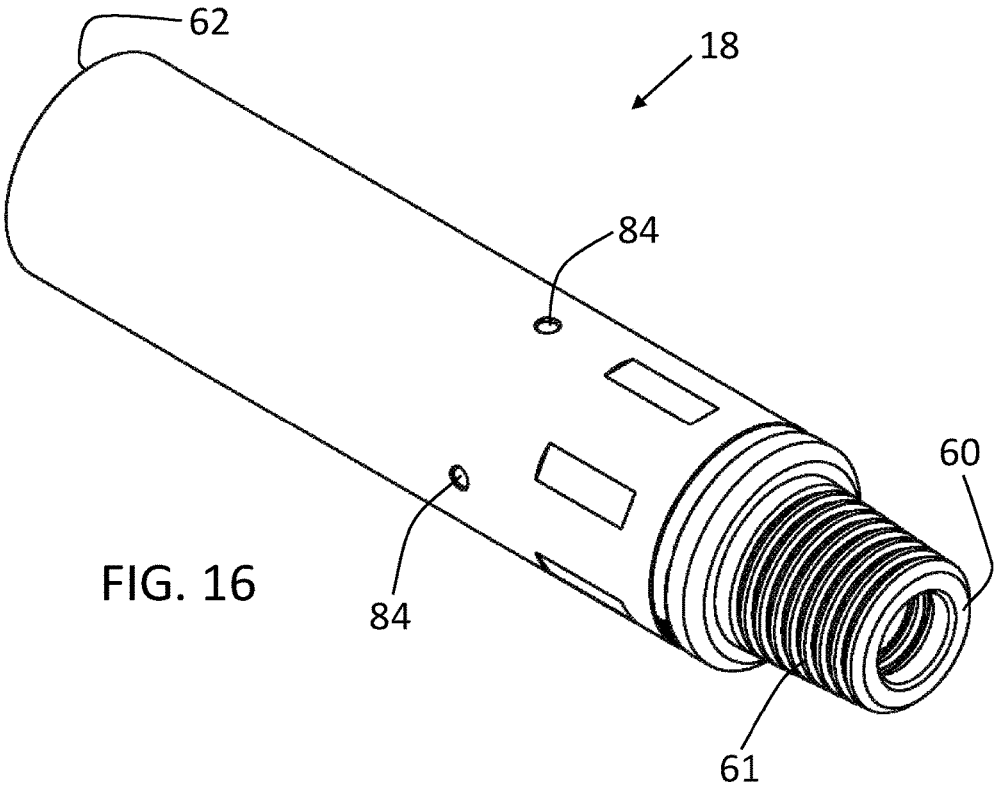
FIG. 16 is a perspective view of the bottom housing of the dual coiled tubing head.
Figure 17:
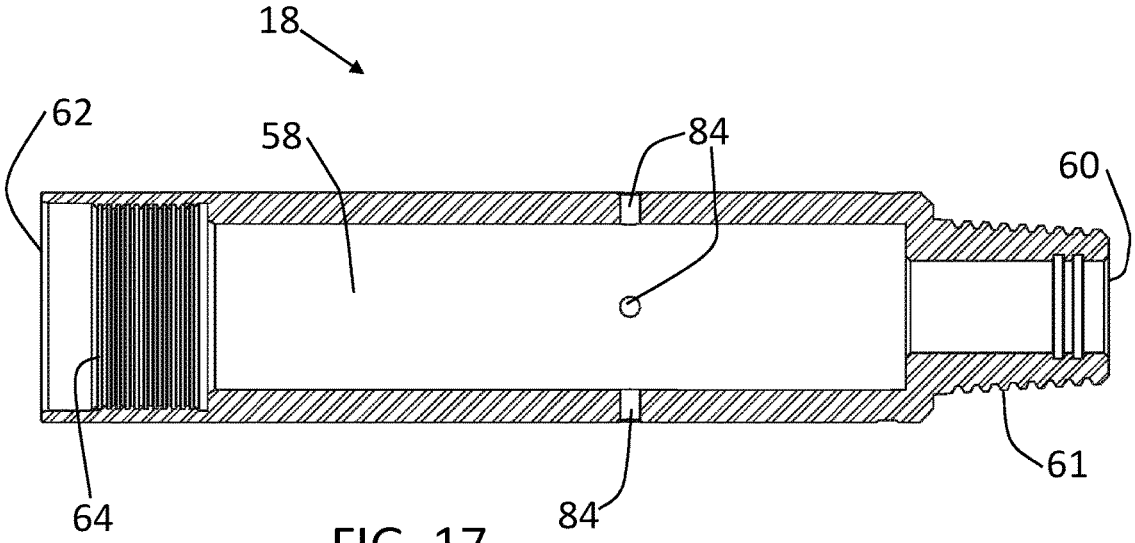
FIG. 17 is a side elevation view, in section, of the bottom housing of the dual coiled tubing head shown in FIG. 16.

Referring to FIG. 16 and FIG. 17, bottom housing 18 has a central passage 58, a bottom end 60 and a top end 62. Top end 62 has a central housing connection 64 with interior threads that threadingly receive bottom housing connection 48 with exterior threads of central housing 16, as shown in FIG. 5. Referring to FIG. 5, central passage 58 is in fluid communication with the peripheral downhole passages 52. Central passage 58 has one-way valves 56 for permitting downhole flow of fluid from exterior coiled tubing connector 12. In the embodiment shown, two one-way valves 56 are provided. By providing more than one one-way valve 56, there is a built in redundancy in the event that one of the one-way valves fails. A person of skill will understand that a single one-way valve 56 or multiple one-way valves 56 may be used. Bottom end 60 of bottom housing 18 is preferably connected to a downhole release tool, not shown, however it will be understood that bottom housing 18 may be connected to other downhole tools or downhole tool string. Referring to FIG. 16, generally, bottom end 60 will have exterior threads 61 for threadingly engaging threads on a downhole tool.

Figure 18:
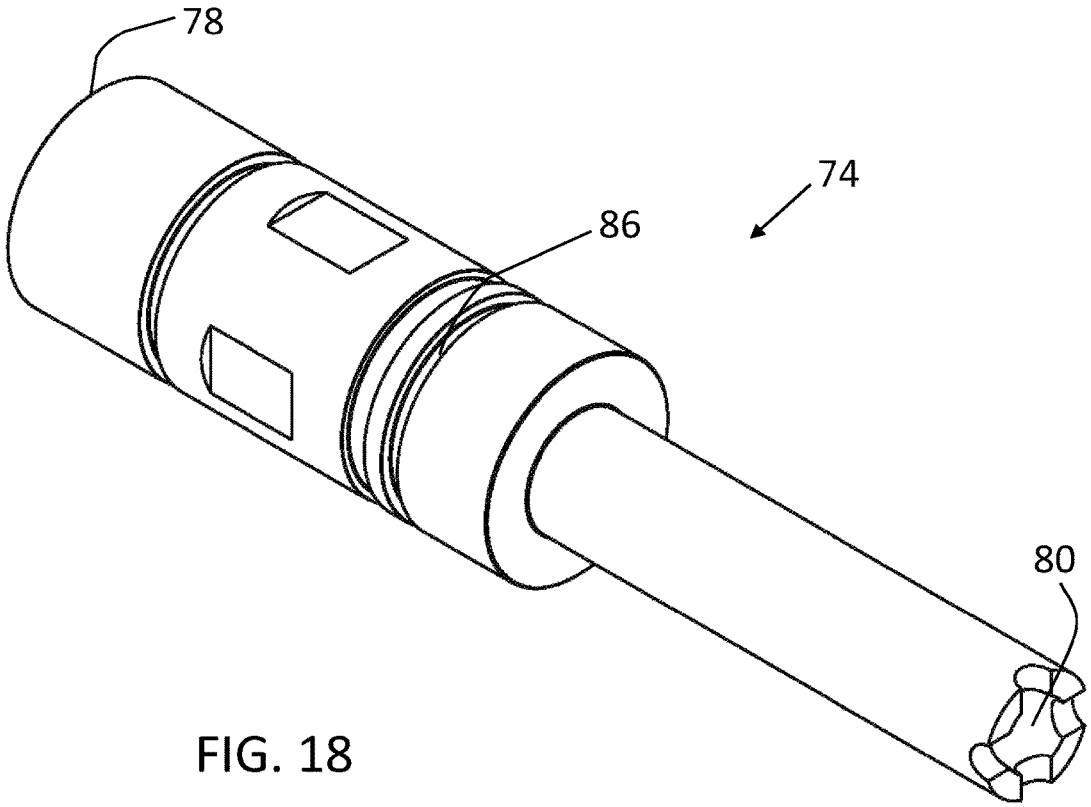
FIG. 18 is a perspective view of the piston housed within the bottom housing of the dual coiled tubing head.
Figure 19:
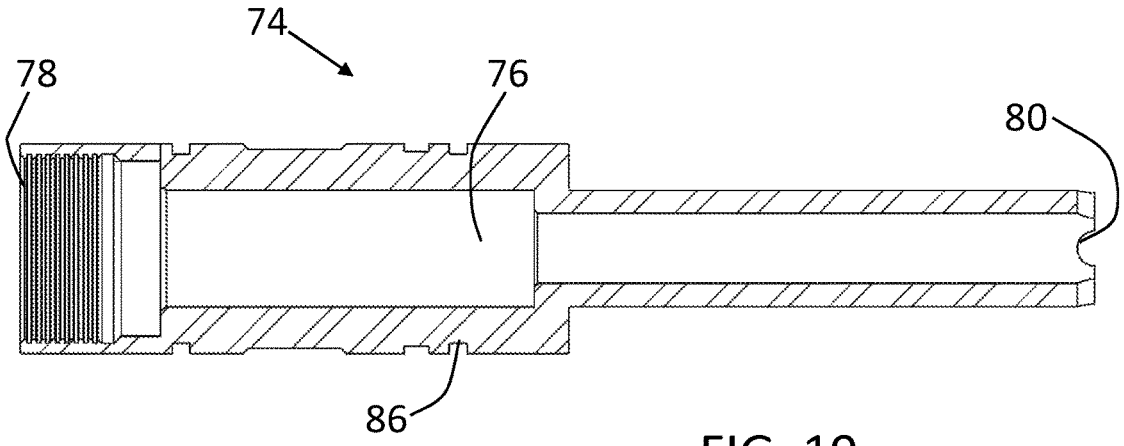
FIG. 19 is a side elevation view, in section, of the piston shown in FIG. 18.

In the event that the tool string becomes stuck in a hole, first piston 63 and a second piston 74 may act as a releasing mechanism for a releasing tool, not shown, attached to bottom end 60 of bottom housing 18. If the coiled tubing cannot be removed, there can be very costly options available to get the equipment out of the hole and could result in the coiled tubing being cut and ruined. Use of the releasing mechanism provides additional options to remove a tool string that has become stuck. A person of skill will understand the type of releasing tool that can be released by the releasing mechanism. Second piston 74 is housed within central passage 58 of bottom housing 18. Referring to FIG. 18 and FIG. 19, second piston 74 has a hollow interior 76, an inlet 78 and an outlet 80. Referring to FIG. 5, inlet 78 is in fluid communication with peripheral downhole passages 52 and houses one-way valves 56 that permit the downward flow of fluid from outer coiled tubing connector 12 through outlet 80, as shown in FIG. 1. It will be understood by a person skilled in the art that the number of inlets 78 will correspond to the number of peripheral downhole passages 52 in central housing 16. Several o-rings 41 are used to seal second piston 74 in central passage 58 of bottom housing 18. A plurality of shear pins 82 are used to maintain second piston 74 in position within bottom housing 18. Shear pins 82 are retained within shear pin apertures 84 of bottom housing 18. Shear pins 82 contact a groove 86 on second piston 74. Referring to FIG. 1, shear pins 82 may be sheared when a ball, not shown, is dropped onto ball seat 68 of first piston 63. This creates pressure on first piston 63 which causes downward movement of first piston 63 within central housing 16 such that it comes into contact with second piston 74 in bottom housing 18. This in turn causes shear pins 82 to be sheared and second piston 74 to drop within bottom housing 18. Second piston 74 contacts a release mechanism within a release tool positioned below dual coiled tubing head 10 to cause release of dual coiled tubing head 10 from the rest of the tools or tool string downhole. A person of skill will understand that second piston 74 may be held in position within central passage 58 by other means in the event that releasing of a tool is not necessary.

Referring to FIG. 1, as can be seen, outer coiled tubing connector 12, inner coiled tubing connector 14, central housing 16 and bottom housing 18 are all substantially cylindrical in shape. A person of skill will understand that the cylindrical shape is beneficial for use downhole. It will also be understood that variations of shape will not have a substantial impact on use of dual coiled tubing head 10.

Figure 2:
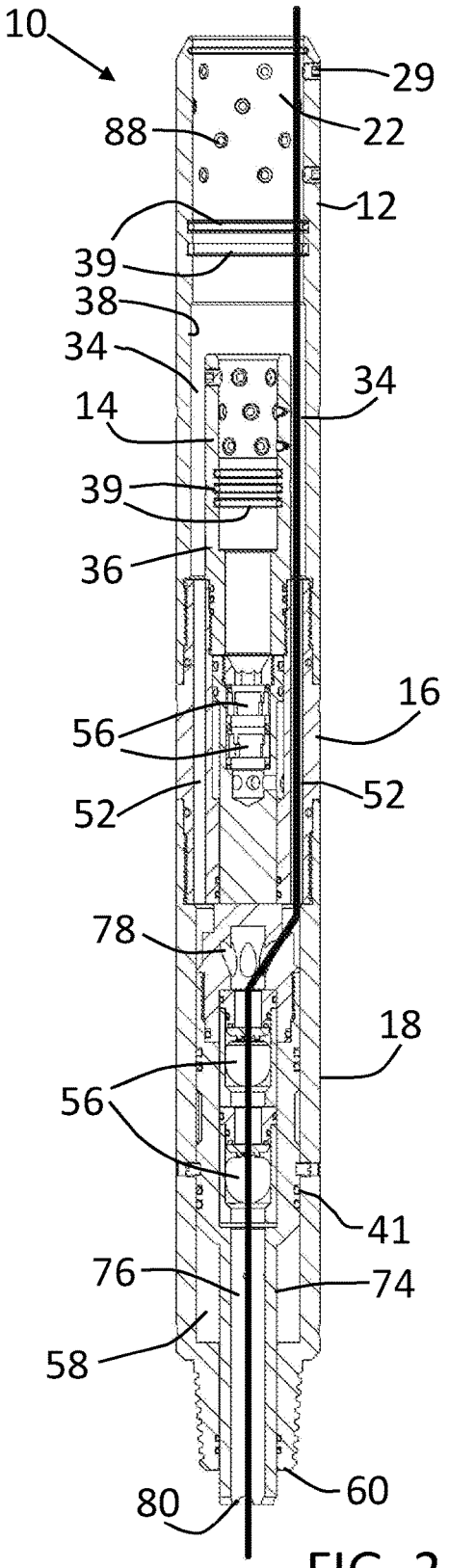
FIG. 2 is a side elevation view, in section, of the dual coiled tubing head shown in FIG. 1 showing flow of drilling fluid.
Figure 3:
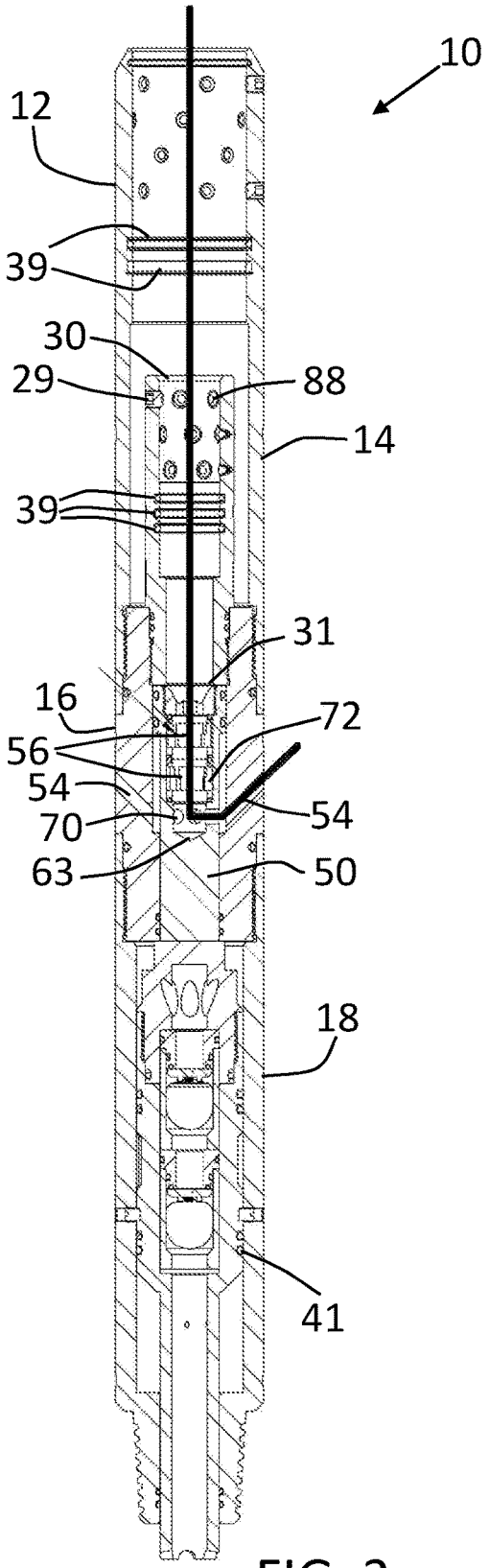
FIG. 3 is a side elevation view, in section, of the dual head shown in FIG. 1 showing flow of nitrogen.

Referring to FIG. 2 and FIG. 3, two separate flow paths are present in dual coiled tubing head 10. Drilling fluid or drilling mud can be pushed downhole to drive the positive displacement motor which in turn drives a mill or drill bit at the bottom of the string. A person of skill will understand what types of fluids are suitable for driving a downhole motor. Nitrogen, or other acceptable fluid, is pumped through the other flow path to create underbalance pressure within the wellbore. The underbalance pressure allows milling or drilling debris to be pushed back to the surface when a well lacks sufficient pressure to overcome the hydrostatic pressure in the wellbore. A person of skill will understand what types of fluids are suitable for this purpose. Fluid, such as nitrogen, flows through inner coiled tubing connector 12 into central passage 50 of central housing 16 and through one-way valves 56 before exiting central housing 16 through outlets 54 into a wellbore. Referring to FIG. 3, in the embodiment shown, fluid flows through inner coiled tubing connector 12 into hollow interior 72 of first piston 63 and through one-way valve 56 before flowing through orifice 70 and outlets 54 where it is vented out of central housing 16 into a wellbore.

Referring to FIG. 2, fluid, such as drilling fluid, flows through passage 34 created between outer surface 36 of inner coiled tubing connector 14 and inner surface 38 of outer coiled tubing connector 12. Fluid continues to flow downwards through peripheral downhole passages 52 of central housing 16 and into central passage 58 of bottom housing 18. Fluid continues downhole through one-way valves 56 before exiting bottom end 60. Bottom end 60 is connected to other downhole tools or bottom hole assembly and fluid continues to flow downward through these tools and bottom hole assembly. When second piston 74 is present, fluid flows through passage 34 created between outer surface 36 of inner coiled tubing connector 14 and inner surface 38 of outer coiled tubing connector 12 and into peripheral downhole passages 52 of central housing 16. Fluid continues to flow through inlet 78 of second piston 74 housed in bottom housing 18 and through one-way valves 56 before continuing downhole through outlet 80 and bottom end 60.

The dual flow paths in the dual coiled tubing head 10 keeps the nitrogen and drilling fluid separate and allows for less fluid to be introduced into the formation which in turn may allow for better production rates. Since nitrogen is vented out into the wellbore instead of traveling to the motor, the motor does not deteriorate as nitrogen is not included in the fluid that is driving it. Also, because the fluid density is higher (because the nitrogen is not included), it drives the motor more consistently which may reduce stalls. Also, the back pressure to the surface may occur more quickly when nitrogen is not present in the drilling fluid which may provide an earlier warning at the surface of a stall or potential stall. Another benefit of the dual coiled tubing head 10 is that cleanout runs may be required less frequently, or eliminated completely, due to increased well control. This may allow for fewer runs in the hole which equates to less cost for drilling operators. A further benefit of dual coiled tubing head 10 is that significantly less fluid may be left in the hole after milling or drilling operations which in turn may reduce the risk of the well being choked off with fluid. This may also reduce the time spent removing the fluid from the well, if it can be removed, to get the well up to full production. Reducing the fluid left in the well after milling operations may also allow for more effective post-milling or drilling operations such as an acid frac.

Referring to FIG. 1, o-rings 41 are used throughout the dual coiled tubing head 10 to seal between the various elements of the dual coiled tubing head 10. A person of skill will understand where o-rings 41 should be placed for preventing leakage of fluid from dual coiled tubing head 10.

When the dual coiled tubing head 10 is connected to dual coiled tubing, the first step is to slide outer coiled tubing connector 12 over the end of the outer coil of dual coiled tubing. The outer coil connector 12 is generally not connected to outer coiled tubing until after inner coiled tubing connector 14 is attached to inner coil of dual coiled tubing. The outer coiled tubing connector 12 and the outer coil of dual coiled tubing are slid upwards until the inner coil of the dual coiled tubing is exposed. Inner coil of dual coiled tubing is pushed into hollow body 28 of inner coiled tubing connector 14 until it has passed seals 39. When desired, inner coil of dual coiled tubing is pre-dimpled using appropriate tools known to persons skilled in the art before set screws are screwed into screw apertures 88 to hold inner coil within inner coiled tubing connector 14. Glue or other products such as Loctite® are used to achieve a secure connection between inner coil of dual coiled tubing and inner coiled tubing connector 14. A person of skill will understand what types of glue or other products are suited for this purpose. Exterior threads 32 of inner coiled tubing connector 14 are threadingly engaged with interior threads 46 of central housing 16. Outer coiled tubing connector 12 can then be slid down into position covering inner coiled tubing connector 12 and interior threads 26 of outer coiled tubing connector 12 are threadingly engaged with exterior threads 44 of central housing. Outer coiled tubing connector 12 is then connected to outer coil of dual coiled tubing. When desired, outer coil of dual coiled tubing is pre-dimpled using appropriate tools known to persons skilled in the art before set screws are screwed into screw apertures 88 to hold outer coil within outer coiled tubing connector 12. As with inner coiled tubing connector 14, glue or other products may be used to achieve a secure connection between the coiled tubing and outer coiled tubing connector 12. Bottom housing 18 is connected to central housing 16 by threadingly engaging exterior threads 48 of bottom end 42 with interior threads 64 of bottom housing 18. Bottom housing 18 may then be connected to any suitable downhole tool or downhole tool string. First piston 63, second piston 74 and one-way valves 56 need to be inserted into their respective housings prior central housing 16 and bottom housing 18 of dual coiled tubing head 10 being assembled on dual coiled tubing.

While the use of set screws is shown in the embodiments provided, a person of skill will understand that different types of attachment methods may be used. These may include but are not limited to the use of slips or a dimple on method. It should be noted that use of the dimple on method is not ideal as it changes the internal diameter of the coiled tubing and would reduce flow rates.

In the embodiment shown, outer coiled tubing connector 12, inner coiled tubing connector 14, central housing 16 and bottom housing 18 are connected together by threads. It will be understood by a person skilled in the art that various other methods of connecting these elements together may be used. These methods may include welding the elements together, using a locking mechanism know in the art or any other method known to a person skilled in the art.

Any use herein of any terms describing an interaction between elements is not meant to limit the interaction to direct interaction between the subject elements, and may also include indirect interaction between the elements such as through secondary or intermediary structure unless specifically stated otherwise.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent that changes may be made to the illustrative embodiments, while falling within the scope of the invention. As such, the scope of the following claims should not be limited by the preferred embodiments set forth in the examples and drawings described above, but should be given the broadest interpretation consistent with the description as a whole.

What is claimed is:

1. A dual coiled tubing head, comprising:

an outer coiled tubing connector having a hollow body, the hollow body having an outer coil connection end and a central housing connection end;

an inner coiled tubing connector having a hollow body, the hollow body having an inner coil connection end and a central housing connection end, the inner coiled tubing connector being sized to fit within the outer coiled tubing connector such that a passage is created between an outer surface of the inner coiled tubing connector and an inner surface of the outer coiled tubing connector to allow for the passage of fluid through the outer coiled tubing connector;

a central housing having a top end and a bottom end, the top end having an exterior connection for connection to the central housing connection end of the outer coiled tubing connector and an interior connection for connection to the central housing connection end of the inner coiled tubing connector, the bottom end having a bottom housing connection, the central housing having a central passage, at least one peripheral downhole passage and at least one outlet connecting the central passage of the central housing to the exterior of the central housing, the central passage of the central housing being in fluid communication with the inner coiled tubing connector and having at least one one-way valve to permit downward flow of fluid, the at least one peripheral downhole passage being in fluid communication with the outer coiled tubing connector, the central passage of the central housing being sealed at the bottom end to prevent the flow of fluid from the inner coiled tubing connector further downhole; and a bottom housing having a central passage, a bottom end and a top end, the top end having a central housing connection for connection to the bottom housing connection of the central housing, the central passage of the bottom housing being in fluid communication with the at least one peripheral downhole passage and having at least one one-way valve for permitting downhole flow of fluid from the exterior coiled tubing connector.

2. The dual coiled tubing head of claim 1 further comprising:

a first piston housed within the central passage of the central housing, the first piston having a ball seat at a top end, a sealed bottom end, at least one orifice and a hollow interior, the hollow interior being in fluid communication with the inner coiled tubing connector and housing the at least one one-way valve that permits downward flow, the at least one orifice being below the at least one one-way valve and in fluid communication with the central passage of the central housing; and a second piston housed within the central passage of the bottom housing, the second piston having a hollow interior, an inlet and an outlet, the inlet being in fluid communication with the at least one peripheral downhole passage and housing the at least one one-way valve for permitting downward flow from the outer coiled tubing connector through the outlet.

3. The dual coiled tubing head of claim 2 wherein a plurality of shear pins are provided in the bottom housing and contact a groove on the second piston for maintaining the second piston in position within the central passage of the bottom housing, the shear pins being sheared when a ball is dropped onto the bail seat of the first piston which causes the first piston to move downwards within the central housing and contacts the second piston in the bottom housing which in turn causes the shear pins to be sheared and the second piston to drop within the bottom housing.

4. The dual coiled tubing head of claim 1 wherein there are two one-way valves in the central housing.

5. The dual coiled tubing head of claim 1 wherein there are two one-way valves in the bottom housing.

6. The dual coiled tubing head of claim 1 wherein there are six pairs of peripheral downhole passages spaced equidistant from the central passage of the central housing.

7. The dual coiled tubing head of claim 1 wherein there are six outlets spaced evenly on the exterior of the central housing.

8. The dual coiled tubing head of claim 1 wherein the outer coiled tubing connector and the inner coiled tubing connector are attached to the coiled tubing using set screws.

9. The dual coiled tubing head of claim 1 wherein the central housing connection of the outer coiled tubing connector having interior threads, the central housing connection of the inner coiled tubing connector having exterior threads, the exterior connection of the central housing having exterior threads for connection to the interior threads of the outer coiled tubing connector, the interior connection of the central housing having interior threads for connection to the exterior threads of the inner coiled tubing connector, the bottom housing connection of the central housing having exterior threads, the central housing connection on the bottom housing having interior threads for connection to the exterior threads of the bottom housing connection of the central housing.

10. A dual coiled tubing head, comprising:

an outer coiled tubing connector having a hollow body, the hollow body having an outer coil connection end and a central housing connection end;

an inner coiled tubing connector having a hollow body, the hollow body having an inner coil connection end and a central housing connection end, the inner coiled tubing connector being sized to fit within the outer coiled tubing connector such that a passage is created between an outer surface of the inner coiled tubing connector and an inner surface of the outer coiled tubing connector to allow for the passage of fluid through the outer coiled tubing connector;

a central housing having a top end and a bottom end, the top end having an exterior connection for connection to the central housing connection end of the outer coiled tubing connector and an interior connection for connection to the central housing connection of the inner coiled tubing connector, the bottom end having a bottom housing connection end, the central housing having a central passage of the central housing, at least one peripheral downhole passage and at least one outlet, the at least one peripheral downhole passage being in fluid communication with the outer coiled tubing connector;

a first piston housed within the central passage of the central housing of the central housing, the first piston having a ball seat at an inlet end, a sealed bottom end, at least one orifice and a hollow interior, the inlet end being in fluid communication with the inner coiled tubing connector and the hollow interior, the hollow interior housing at least one one-way valve that permits downward flow, the at least one orifice being below the at least one one-way valve and in fluid communication with the at least one outlet of the central housing; and a bottom housing having a central passage, a bottom end and a top end, the top end having a central housing connection for connection to the bottom housing connection of the central housing, the central passage of the bottom housing being in fluid communication with the at least one peripheral downhole passage and having at least one one-way valve for permitting downhole flow of fluid from the exterior coiled tubing connector.

11. The dual coiled tubing head of claim 10 further comprising a second piston housed within the central passage of the bottom housing, the second piston having a hollow interior, an inlet and an outlet, the inlet being in fluid communication with the at least one peripheral downhole passage and housing the at least one one-way valve for permitting downward flow from the outer coiled tubing connector through the outlet.

12. The dual coiled tubing head of claim 11 wherein a plurality of shear pins are provided in the bottom housing and contact a groove on the second piston for maintaining the second piston in position within the central passage of the bottom housing, the shear pins being sheared when a bail is dropped onto the ball seat of the first piston which causes the first piston to move downwards within the central housing and contacts the second piston in the bottom housing which in turn causes the shear pins to be sheared and the second piston to drop within the bottom housing.

13. The dual coiled tubing head of claim 10 wherein there are two one-way valves in the central housing.

14. The dual coiled tubing head of claim 10 wherein there are two one-way valves in the bottom housing.

15. The dual coiled tubing head of claim 10 wherein there are six pairs of peripheral downhole passages spaced equidistant from the central passage of the central housing.

16. The dual coiled tubing head of claim 10 wherein there are six outlets spaced evenly on the exterior of the central housing.

17. The dual coiled tubing head of claim 10 wherein the outer coiled tubing connector and the inner coiled tubing connector are attached to the coiled tubing using set screws.

18. The dual coiled tubing head of claim 10 wherein the central housing connection of the outer coiled tubing connector having interior threads, the central housing connection of the inner coiled tubing connector having exterior threads, the exterior connection of the central housing having exterior threads for connection to the interior threads of the outer coiled tubing connector, the interior connection of the central housing having interior threads for connection to the exterior threads of the inner coiled tubing connector, the bottom housing connection of the central housing having exterior threads, the central housing connection on the bottom housing having interior threads for connection to the exterior threads of the bottom housing connection of the central housing.

* * * * *